US010962003B2

(12) United States Patent
Kataoka et al.

(10) Patent No.: US 10,962,003 B2
(45) Date of Patent: Mar. 30, 2021

(54) ELECTRIC OIL PUMP APPARATUS AND BASE PLATE FOR ELECTRIC OIL PUMP

(71) Applicant: Nidec Tosok Corporation, Zama (JP)

(72) Inventors: Shigehiro Kataoka, Zama (JP); Yoshiyuki Kobayashi, Zama (JP); Koji Higuchi, Zama (JP)

(73) Assignee: NIDEC TOSOK CORPORATION, Kanagawa (JP)

( * ) Notice: Subject to any disclaimer, the term of this patent is extended or adjusted under 35 U.S.C. 154(b) by 380 days.

(21) Appl. No.: 15/921,706

(22) Filed: Mar. 15, 2018

(65) Prior Publication Data

US 2018/0274540 A1 Sep. 27, 2018

(30) Foreign Application Priority Data

Mar. 23, 2017 (JP) ..... JP2017-057251

(51) Int. Cl.
*F04C 15/00* (2006.01)
*F04C 2/10* (2006.01)
*F01M 1/02* (2006.01)

(52) U.S. Cl.
CPC ..... *F04C 15/0034* (2013.01); *F04C 2/10* (2013.01); *F01M 2001/0284* (2013.01); *F04C 2240/30* (2013.01); *F04C 2240/40* (2013.01)

(58) Field of Classification Search
CPC ..... F04C 2240/30; F04C 2240/40; F04C 2210/206; F04C 15/0034; F04C 2/10; F01M 2001/0284
See application file for complete search history.

(56) References Cited

U.S. PATENT DOCUMENTS

| | | | | |
|---|---|---|---|---|
| 9,441,628 | B2 * | 9/2016 | Sakata | F04C 2/102 |
| 9,453,508 | B2 * | 9/2016 | Suzuki | F04C 2/102 |
| 10,087,932 | B2 * | 10/2018 | Huang | F04C 15/008 |
| 10,502,212 | B2 * | 12/2019 | Lee | F04C 18/0215 |
| 2011/0211980 | A1 * | 9/2011 | Shibuya | H05K 7/1432 417/410.1 |
| 2013/0202464 | A1 * | 8/2013 | Miyaki | F04C 11/008 417/410.4 |
| 2014/0054991 | A1 * | 2/2014 | Hyodo | F04C 15/008 310/71 |
| 2017/0321794 | A1 * | 11/2017 | Kiehlneker | F16H 57/0434 |
| 2019/0242340 | A1 * | 8/2019 | Becker | H02K 5/12 |

FOREIGN PATENT DOCUMENTS

JP 2014-66180 A 4/2014

* cited by examiner

*Primary Examiner* — Christopher S Bobish
(74) *Attorney, Agent, or Firm* — Keating & Bennett

(57) ABSTRACT

An electric oil pump apparatus includes an electric oil pump including a housing main body that accommodates a motor and a pump driven by the motor, a flange portion formed on the housing main body, and a control circuit case for accommodating a control circuit, and a base plate attached to the electric oil pump. The base plate includes an annular main body fixed to the housing main body, and a sealing member located between the annular main body and the housing main body. The annular main body includes a first surface located on one side, a second surface located on the other side, a first through hole for passing the housing main body therethrough, and an annular stepped portion configured to accommodate the sealing member, and formed along an inner edge of the first through hole. The first surface of the base plate is opposed to the flange portion.

18 Claims, 10 Drawing Sheets

ELECTRIC OIL PUMP APPARATUS AND BASE PLATE FOR ELECTRIC OIL PUMP

CROSS REFERENCE TO RELATED APPLICATIONS

This application claims the benefit of priority to Japanese Patent Application No. 2017-057251 filed on Mar. 23, 2017. The entire contents of this application are hereby incorporated herein by reference.

BACKGROUND OF THE INVENTION

1. Field of the Invention

The present invention relates to an electric oil pump apparatus, and a base plate for the electric oil pump.

2. Description of the Related Art

These days, the structure of an electric oil pump mounted on a transmission is designed in accordance with the joint portion to the transmission.

For example, Japanese Unexamined Patent Application Publication No. 2014-066180 discloses a structure in which a tapered surface is formed on an end portion of a contact surface with the electric oil pump, on the side of the transmission, and a seal ring is provided on the tapered surface.

Between the electric oil pump and the transmission, as mentioned above, the seal ring is provided to prevent oil leakage.

However, with the structure according to Japanese Unexamined Patent Application Publication No. 2014-066180, since the tapered surface is formed on the side of the transmission, the electric oil pump has to be designed so as to allow the use of the seal ring that fits the tapered surface on the side of the transmission. In other words, the electric oil pump that fits the structure of the transmission is required, and therefore a general-purpose electric oil pump is unable to be designed.

In addition, when a press-formed housing is employed in the electric oil pump, it is difficult to form a recess for a seal ring, such as an O-ring, to be fitted in.

Accordingly, the invention provides a general-purpose electric oil pump apparatus capable of securing a sealing effect with a simple structure, and configured to eliminate the need to form a recess for a seal ring to be fitted in, in a housing.

SUMMARY OF THE INVENTION

In an aspect, the invention provides an electric oil pump apparatus including an electric oil pump, and a base plate attached to the electric oil pump. The electric oil pump includes a cylindrical housing main body that accommodates a motor having an output shaft that rotates about a central axis extending in an axial direction, and a pump driven by the motor, a flange portion extending radially outward from an outer circumferential surface of the housing main body, and a control circuit case provided on one side of the flange portion in the axial direction, and in which a control circuit that controls the motor is accommodated. The base plate includes an annular main body fixed to the outer circumferential surface of the housing main body, and a sealing member located between the annular main body and the housing main body. The annular main body includes a first surface located on one side in the axial direction, a second surface located on the other side in the axial direction, a first through hole through which the housing main body is passed, and an annular stepped portion configured to accommodate the sealing member, and formed along an inner edge of the first through hole. The base plate is fastened such that the first surface is opposed to the flange portion.

With the foregoing configuration, a general-purpose electric oil pump apparatus is provided that is capable of securing a sealing effect with a simple structure, and configured to eliminate the need to form a recess for a seal ring to be fitted in, in a housing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
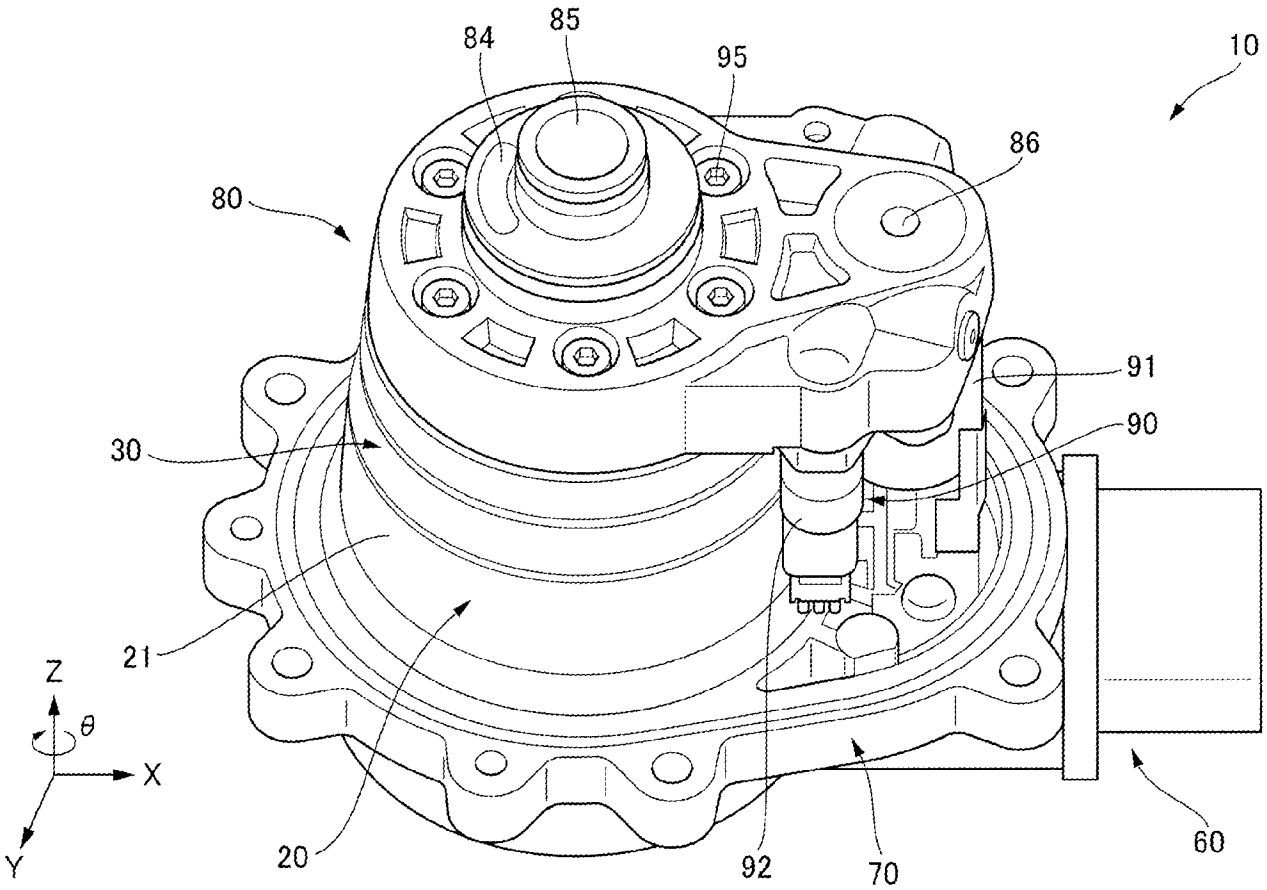
FIG. 1 is a perspective view showing an electric oil pump apparatus according to an embodiment of the invention.

Hereafter, an electric oil pump apparatus according to an embodiment of the invention will be described, with reference to the drawings. In the drawings, the reduction scale and the number of components may differ from the actual ones, for the sake of clarity.

Some of the drawings include an XYZ coordinate system, which is a 3D orthogonal coordinate system. In the XYZ coordinate system, the Z-axis direction is defined as a direction parallel to the axial direction of a central axis J shown in FIG. 2. The X-axis direction is defined as a direction parallel to the direction in which a busbar 64 shown in FIG. 2 extends, in other words a left-right direction in FIG. 1. The Y-axis direction is defined as a direction orthogonal to both of the X-axis direction and the Z-axis direction.

In the following description, the positive side of the Z-axis direction (+Z side) will be referred to as "front side", and the negative side of the Z-axis direction (−Z side) will be referred to as "rear side". However, the rear side and the front side are terms used merely for the purpose of description, and not intended to limit the actual positional relation and directions. In addition, a direction parallel to the central axis J (Z-axis direction) will be simply referred to as "axial direction", a radial direction about the central axis J will be simply referred to as "radial direction", and a circumferential direction about the central axis J, in other words around the central axis J (θ direction), will be simply referred to as "circumferential direction", unless otherwise specifically noted.

Further, an expression "extend in the axial direction" hereinafter used includes not only the case of extending in the axial direction (Z-axis direction) in the strict sense, but also the case of extending in a direction inclined at an angle narrower than 45°, with respect to the axial direction. Likewise, an expression "extend in the radial direction" hereinafter used includes not only the case of extending in the axial direction (Z-axis direction) in the strict sense, but also the case of extending in a direction inclined at an angle narrower than 45°, with respect to the radial direction.

FIG. 1 is a perspective view showing an electric oil pump apparatus according to this embodiment.

The electric oil pump apparatus 10 according to this embodiment includes a motor unit 20, a pump unit 30, a control circuit unit 60, a base plate unit 70, a pump cover unit 80, and a solenoid unit 90. The motor unit 20 and the pump unit 30 are both located inside a housing 21. The motor unit 20, the pump unit 30, and the pump cover unit 80 are aligned in the axial direction. The pump cover unit 80 includes an intake path 84, a first discharge path 85, and a second discharge path 86, each of which serves as an entrance or an exit of oil.

Figure 2:
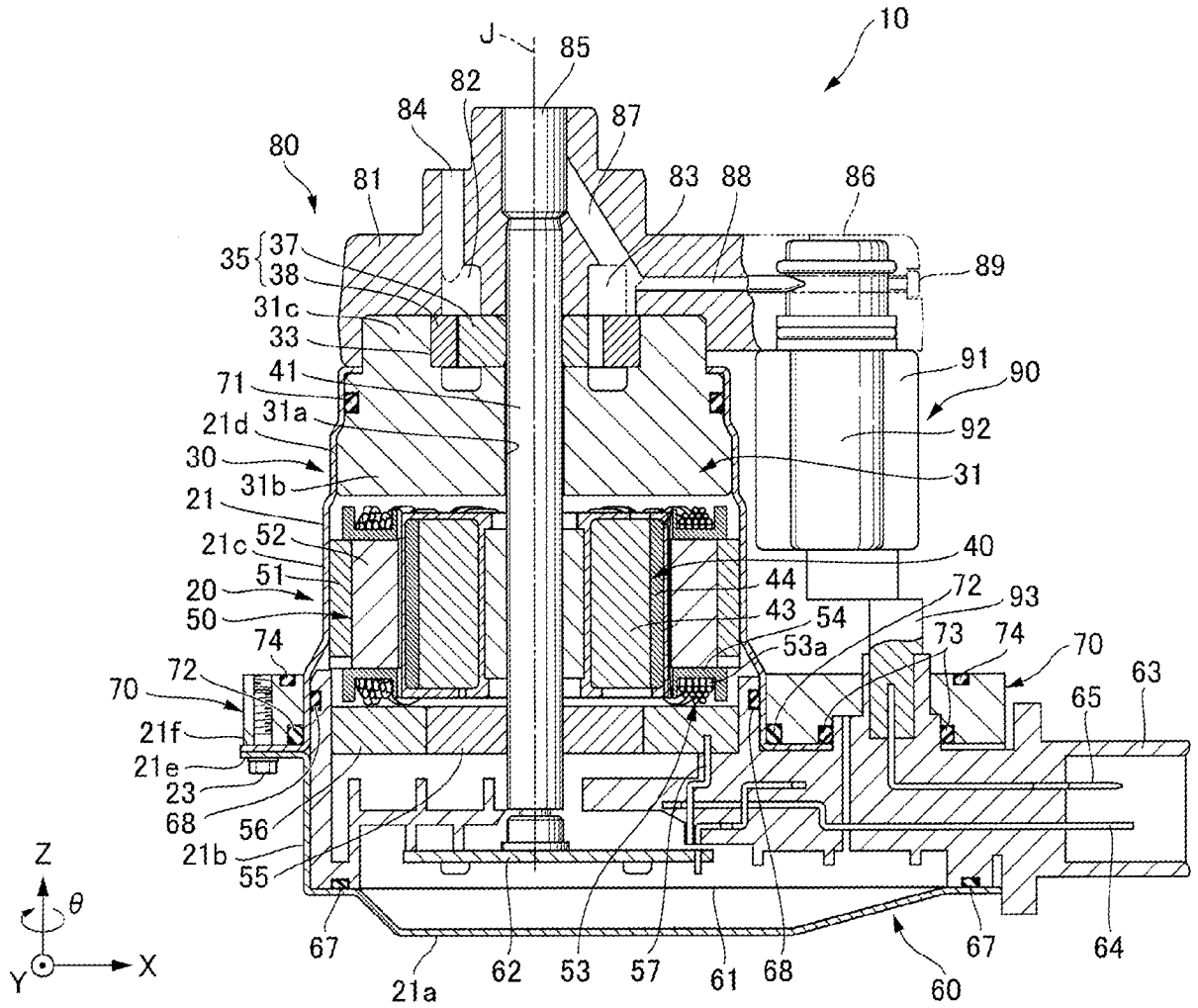
FIG. 2 is a partial cross-sectional view of the electric oil pump apparatus according to the embodiment.

FIG. 2 is a partial cross-sectional view of the electric oil pump apparatus according to this embodiment.

The motor unit 20 includes a shaft 41, supported so as to rotate about the central axis J extending in the axial direction, to drive the pump by causing the shaft 41 to rotate. The pump unit 30 is located on the front side (+Z side) of the motor unit 20, to be driven by the motor unit 20 via the shaft 41, so as to discharge the oil. The control circuit unit 60 is located on the rear side (−Z side) of the motor unit 20, and controls the operation of the motor unit 20. The base plate unit 70 is located on the front side (+Z side) of the control circuit unit 60, so as to surround the outer circumference of the housing 21, and serves to seal the motor unit 20, the pump unit 30, and the control circuit unit 60. The pump cover unit 80 is located on the front side (+Z side) of the pump unit 30, and attached to the main body accommodating the motor unit 20 and the pump unit 30, and the solenoid unit 90. The solenoid unit 90 detects the pressure of the oil circulating in the pump unit 30, and adjusts the oil amount.

Hereunder, each of the mentioned components will be described in further detail.

The motor unit 20 includes, as shown in FIG. 2, the housing 21, a rotor 40, the shaft 41, a stator 50, a bearing unit 55, and a busbar assembly 56.

The motor unit 20 is, for example, an inner-rotor motor, in which the rotor 40 is fixed to the outer circumferential surface of the shaft 41, and the stator 50 is located on the radially outer side of the rotor 40. The bearing unit 55 is provided on the radially outer side of the shaft 41, and on the rear side (−Z side) of the rotor 40, to rotatably support the shaft 41. The busbar assembly 56 is located on the radially outer side of the bearing unit 55, to fix the bearing unit 55 from the radially outer side. In addition, the busbar assembly 56 is electrically connected to the stator 50.

The housing 21 has a bottomed cylindrical shape with a thin wall, and accommodates the motor unit 20, the pump unit 30, and the control circuit unit 60, as shown in FIG. 2. The housing 21 may be formed of, for example, a zinc-aluminum-magnesium-based alloy, and more particularly a steel sheet and steel strip plated with molten zinc-aluminum-magnesium alloy. The housing 21 includes a bottom portion 21*a*, a control circuit retaining portion 21*b*, a stator retaining portion 21*c*, a pump body retaining portion 21*d*, and flange portions 21*e* and 21*f*. The bottom portion 21*a* corresponds to the bottom of the cylindrical shape. The control circuit retaining portion 21*b*, the stator retaining portion 21*c*, and the pump body retaining portion 21*d* each constitute a side wall face of a cylindrical shape about the central axis J. In this embodiment, the inner diameter of the control circuit retaining portion 21*b* is larger than that of the stator retaining portion 21*c*, and the inner diameter of the stator retaining portion 21*c* is larger than that of the pump body retaining portion 21*d*.

A control circuit case 61, which will be subsequently described, is accommodated inside the control circuit retaining portion 21*b* and on the front side (+Z side) of the bottom portion 21*a*. To the inner face of the stator retaining portion 21*c*, the outer face of the stator 50, in other words the outer face of a core back portion 51, which will be subsequently described, is fitted. Thus, the stator 50 is accommodated in the housing 21. To the inner face of the pump body retaining portion 21*d*, the outer face of a pump body 31, which will be subsequently described, is fitted. Thus, the pump body 31 is accommodated in the housing 21.

The flange portion 21*e* extends radially outward from a front side (+Z side) end portion of the control circuit retaining portion 21*b*. The flange portion 21*f* extends radially outward from a rear side (−Z side) end portion of the stator retaining portion 21*c*.

The flange portion 21*e* and the flange portion 21*f* are opposed to each other, and joined together with a fastening device 23. Thus, the motor unit 2, the pump unit 30, and the control circuit unit 60 are fixed inside the housing 21, in a sealed state.

Here, the bottom portion 21*a*, the control circuit retaining portion 21*b*, and the flange portion 21*e* collectively constitute a control circuit cover.

The rotor 40 includes a rotor core 43 and a rotor magnet 44. The rotor core 43 is fixed to the shaft 41, so as to surround the shaft 41 in the θ direction. The rotor magnet 44 is fixed to the outer face of the rotor core 43 in the θ direction. The rotor core 43 and the rotor magnet 44 rotate together with the shaft 41.

The stator 50 is located so as to surround the rotor 40 in the θ direction, and causes the rotor 40 to rotate about the central axis J. The stator 50 includes the core back portion 51, teeth 52, a coil 53, and an insulator (bobbin) 54.

The core back portion 51 has a cylindrical shape, concentric with the shaft 41. The teeth 52 each extend toward the shaft 41, from the inner surface of the core back portion 51. The teeth 52 are aligned on the inner circumferential surface of the core back portion 51, at regular intervals. The coil 53 is formed of a conductive wire 53*a* wound around the insulator (bobbin) 54. The insulator (bobbin) 54 is attached to each of the teeth 52.

The bearing unit 55 is located on the rear side (−Z side) of the rotor 40 and the stator 50, and serves to support the shaft 41. The bearing unit 55 is supported by the busbar assembly 56 from the radially outer side. The shape and the structure of the bearing unit 55 are not specifically limited, and any known bearing may be employed.

The busbar assembly 56 is connected, via a terminal 57, to a control circuit 62 which will be subsequently described. The busbar assembly 56 is also electrically connected to an external power source and the stator 50, to supply a current to the stator 50.

The control circuit unit 60 is located on the rear side (−Z side) of the motor unit 20, and controls the operation of the motor unit 20.

The control circuit unit 60 includes a control circuit case 61, a control circuit 62, a power supply opening 63, a busbar 64, and a wiring member 65. The motor unit 20 is connected to the external power source via the control circuit unit 60.

The control circuit case 61 accommodates the control circuit 62.

The busbar 64 and the wiring member 65 radially extend toward the +X side inside the control circuit case 61, such that the respective leading end portions stick out in the power supply opening 63. The external power source is electrically connected to the busbar 64 and the wiring member 65. Accordingly, a drive current is supplied to the coil 53 of the stator 50 and a non-illustrated rotation sensor, through the busbar 64 and the wiring member 65. The drive current supplied to the coil 53 is controlled, for example, according to the rotational position of the rotor 40 measured by the rotation sensor. When the drive current is supplied to the coil 53, a magnetic field is generated, which causes the rotor 40 to rotate. Thus, the motor unit 20 gains the rotational driving force.

The pump unit 30 is provided on one side of the motor unit 20 in the axial direction, and more particularly on the front side (+Z side). The pump unit 30 has a rotation axis that coincides with that of the motor unit 20, and is driven by the motor unit 20 via the shaft 41. The pump unit 30 includes a positive displacement pump that delivers oil with pressure, through expansion and contraction of a sealed space (oil chamber). The positive displacement pump can be typically exemplified by a trochoid pump. The pump unit 30 includes a pump body 31 and a pump rotor 35.

The pump body 31 is located on the front side (+Z side) of the motor unit 20. The pump body 31 includes a pump main body 31*b*, a through hole 31*a* extending in the axial direction of the central axis J through the inside of the pump main body 31*b*, and a protruding portion 31*c* sticking out to the front side (+Z side) in a cylindrical shape, from the pump main body 31*b*. The inner diameter of the protruding portion 31*c* is larger than that of the through hole 31*a*. The protruding portion 31*c* and the pump main body 31*b* define a recess 33 open toward the pump cover unit 80. The through hole 31*a* is open toward the motor unit 20 on the rear side (−Z side), and toward the recess 33 on the front side (+Z side). The through hole 31*a* 1, serves as a bearing member through which the shaft 41 is inserted, and rotatably supports the shaft 41. The recess 33 serves as a pump chamber in which the pump rotor 35 is accommodated, and therefore may hereinafter be also referred to as pump chamber 33.

The pump body 31 is fixed inside the pump body retaining portion 21*d*, on the front side (+Z side) of the motor unit 20. An O-ring 71 is provided, radially between the outer circumferential surface of the pump main body 31*b* and the inner circumferential surface of the pump body retaining portion 21*d*. Accordingly, the portion radially between the outer circumferential surface of the pump main body 31*b*, and the inner circumferential surface of the pump body retaining portion 21*d* pump body 31, is sealed.

To form the pump body 31, for example, cast iron may be employed

The pump rotor 35 is attached to the front side (+Z side) end portion of the shaft 41, and accommodated in the pump chamber 33. The pump rotor 35 includes an inner rotor 37 attached to the shaft 41, and an outer rotor 38 surrounding the inner rotor 37 on the radially outer side.

The inner rotor 37 is an annular gear, having the teeth on the radially outer surface. The inner rotor 37 is fixed to the shaft 41, by press-inserting the front side (+Z side) end portion of the shaft 41 to the inner side of the inner rotor 37. The inner rotor 37 rotates together with the shaft 41, in the θ direction.

The outer rotor 38, surrounding the inner rotor 37 on the radially outer side, is an annular gear having the teeth on the radially inner surface. The outer rotor 38 is rotatably accommodated in the pump chamber 33. The outer rotor 38 includes a non-illustrated inner chamber, for example having a star shape, in which the inner rotor 37 is accommodated. The outer rotor 38 has a larger number of inner teeth, than the number of outer teeth of the inner rotor 37.

The inner rotor 37 and the outer rotor 38 are meshed with each other, so that when the inner rotor 37 is caused to rotate by the shaft 41, the outer rotor 38 is caused to rotate by the inner rotor 37. When the inner rotor 37 and the outer rotor 38 rotate, the volume of the space defined between the inner rotor and the outer rotor 38 varies depending on the rotational position. The pump rotor 35 utilizes such variation of the volume, to introduce the oil through an inlet port 82, pressurize the introduced oil, and discharge the oil through an outlet port 83. The inlet port 82 and the outlet port 83 will be subsequently described. In this embodiment, the region where the volume increases (i.e., the oil is introduced), in the space defined between the inner rotor 37 and the outer rotor 38, will be referred to as a negative-pressure region.

The base plate unit 70 is located on the radially outer side of the housing 21, on the front side (+Z side) of the control circuit unit 60, and serves to seal the motor unit 20, the pump unit 30, and the control circuit unit 60. The specific structure of the base plate unit 70 will be subsequently described.

The pump cover unit 80 is located on the front side (+Z side) of the pump body 31. The pump cover unit 80 includes a pump cover main body 81, the inlet port 82, the outlet port 83, an intake path 84, a first discharge path 85, a second discharge path 86, a first oil path 87, a second oil path 88, and a sealing member 89.

The pump cover main body 81 is attached to the pump body 31, on the front side (+Z side). The pump cover main body 81 is normally formed of a metal such as an aluminum alloy, and exhibits high heat dissipation performance because of a large thermal capacity and surface area. In addition, the oil of a certain temperature (e.g., 120° C.) or lower flows inside the pump cover main body 81, and therefore an increase in temperature of the pump cover main body 81 is suppressed.

The inlet port 82 is a C-shaped groove, in a view from the front side (+Z side) of the pump cover unit 80. As the volume of the space defined between the inner rotor 37 and the outer rotor 38 increases, the inlet port 82 communicates with the pump rotor 35, to an extent proportional to the increase of the volume. Likewise, the outlet port 83 is also a C-shaped groove, in a view from the front side (+Z side) of the pump cover unit 80. As the volume of the space defined between the inner rotor 37 and the outer rotor 38 decreases, the outlet port 83 communicates with the pump rotor 35, to an extent proportional to the decrease of the volume.

The intake path 84 has, as shown in FIG. 1, a C-shape in a view from the front side (+Z side). The intake path 84 communicates with a non-illustrated oil pan via a non-illustrated pipe, so that the oil stocked in the oil pan is introduced through the intake path 84.

The first discharge path 85 has a hollow cylindrical shape. The front end portion of the shaft 41 penetrates through the bottom of the first discharge path 85, so as to partially stick out toward the front side (+Z side). The first discharge path 85 is connected to a non-illustrated main flow path of a control valve, and the main flow path is connected, for example, to a clutch side. Thus, the oil discharged through the first discharge path 85 is supplied to the clutch side.

The second discharge path 86 has a circular shape in a view from the front side (+Z side), as shown in FIG. 1. The second discharge path 86 is connected to the non-illustrated oil pan. Thus, the oil discharged through the second discharge path 86 is delivered to the oil pan.

The first oil path 87 has the rear side (−Z side) end portion connected to the outlet port 83, and the front side (+Z side) end portion connected to the first discharge path 85. The second oil path 88 radially extends inside the pump cover main body 81. The second oil path 88 has the −X side end portion connected to the first oil path 87, and the +X side end portion connected to the outer circumferential portion of the pump cover main body 81. In other words, the second oil path 88 is branched from the first oil path 87. The +X side end portion of the second oil path 88 is sealed with the sealing member 89, such as a screw.

The intake path 84 and the first discharge path 85 communicate with the pump chamber 33, via the inlet port 82 and the outlet port 83 respectively. Accordingly, the oil can be introduced into the pump chamber 33, and discharged therefrom.

The solenoid unit 90 is located on the +X side of the housing 21 in the radial direction, and supported by the pump cover main body 81. The solenoid unit 90 includes a solenoid valve 91 and a pressure sensor 92. The solenoid valve 91 adjusts the amount of the oil circulating in the pump cover main body 81. The pressure sensor 92 detects the pressure of the oil circulating in the pump cover main body 81.

The solenoid valve 91 has a cylindrical shape, and for example the longitudinal side is oriented parallel to the central axis J, on the +X side of the housing 21 in the radial direction. The amount of the oil flowing toward the solenoid valve 91 is adjusted by an electromagnetic valve in the solenoid valve 91.

Figure 9:
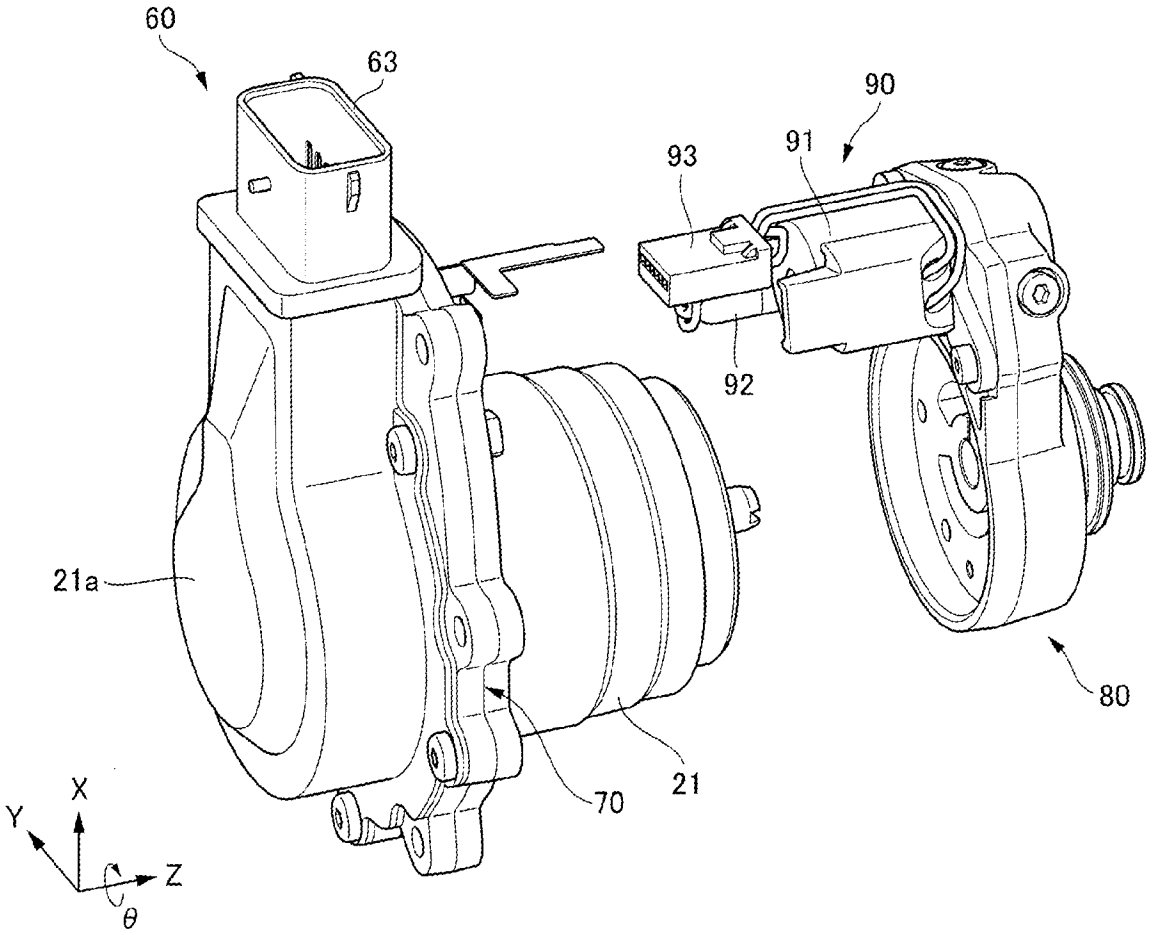
FIG. 9 is a perspective view for explaining the assembly process of the electric oil pump apparatus according to the embodiment.

The pressure sensor 92 is, like the solenoid valve 91, located on the +X side of the housing 21 in the radial direction. However, as shown in FIG. 1 and FIG. 9 to be subsequently referred to, the pressure sensor 92 is located on the +Y side with respect to the solenoid valve 91. The pressure sensor 92 has a bar shape, and is located such that the longitudinal side is oriented parallel to the central axis J.

Referring now to FIG. 3 to FIG. 10, an assembly process of the electric oil pump apparatus 10 according to this embodiment will be described hereunder.

Figure 3:
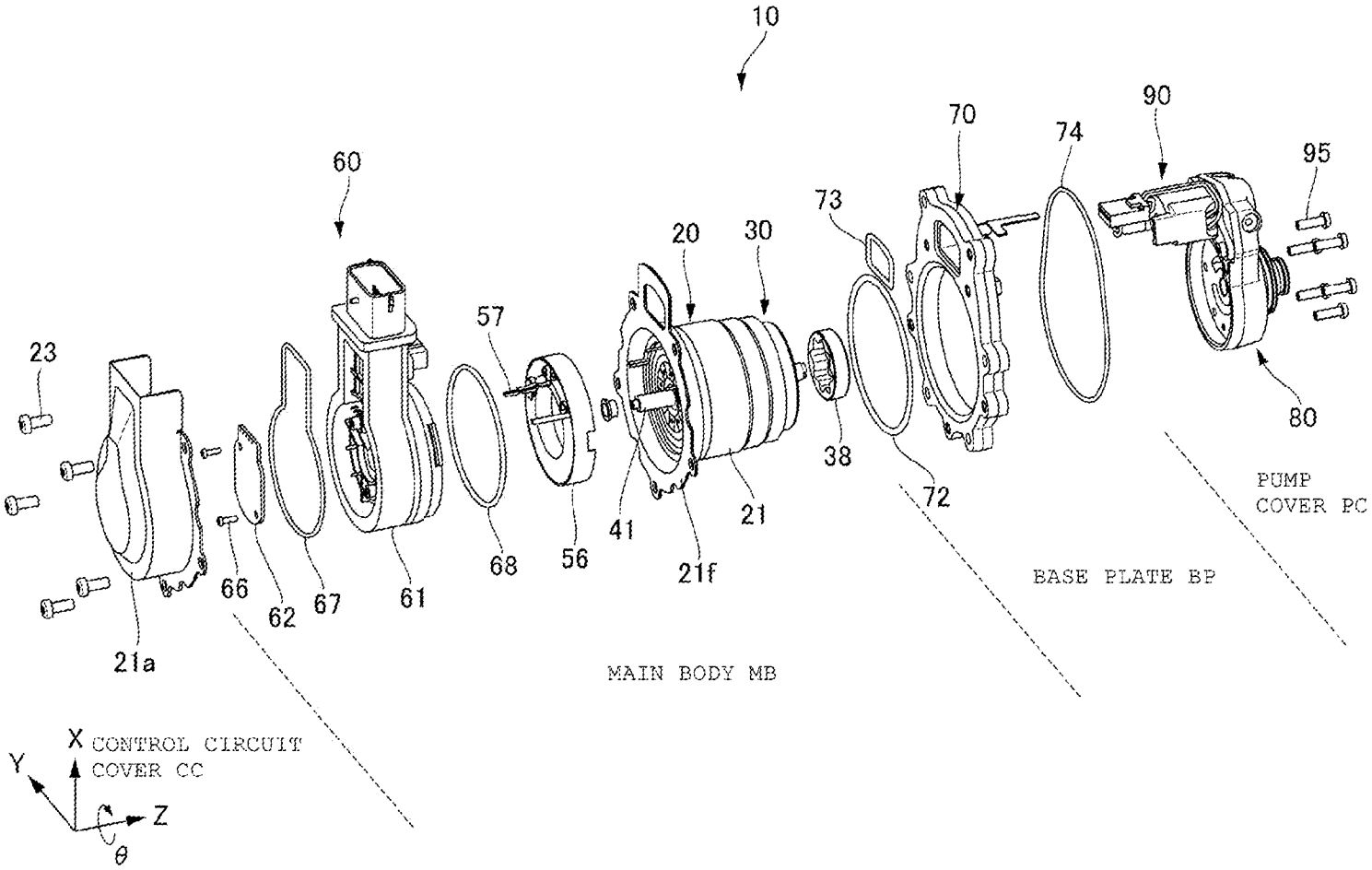
FIG. 3 is an exploded perspective view of the electric oil pump apparatus according to the embodiment.

FIG. 3 is an exploded perspective view of the electric oil pump apparatus according to this embodiment.

The assembly process of the electric oil pump apparatus 10 according to this embodiment can be divided, for example, into (1) assembly of the main body MB, (2) attaching the base plate BP to the main body MB, (3) attaching a control circuit cover CC to the main body MB, and (4) attaching the pump cover PC to the main body MB, each of which will be sequentially described hereunder.

Referring to FIG. 3, the outer rotor 38 is attached to the housing 21 from the side of the pump unit 30. In the housing 21, the motor unit 20 and the pump unit 30 are mounted in advance. From the side of the motor unit 20, the busbar assembly 56 with the terminal 57 is set inside the housing 21, and then the control circuit unit 60 is attached. The control circuit unit 60 may be assembled through attaching the control circuit 62 to the control circuit cover CC with a screw 66, attaching an O-ring 68 serving as the sealing member, to the outer circumferential surface of the end portion of the main body MB, and attaching an O-ring 67 serving as the sealing member, to the face opposing the bottom portion 21*a*.

Figure 4:
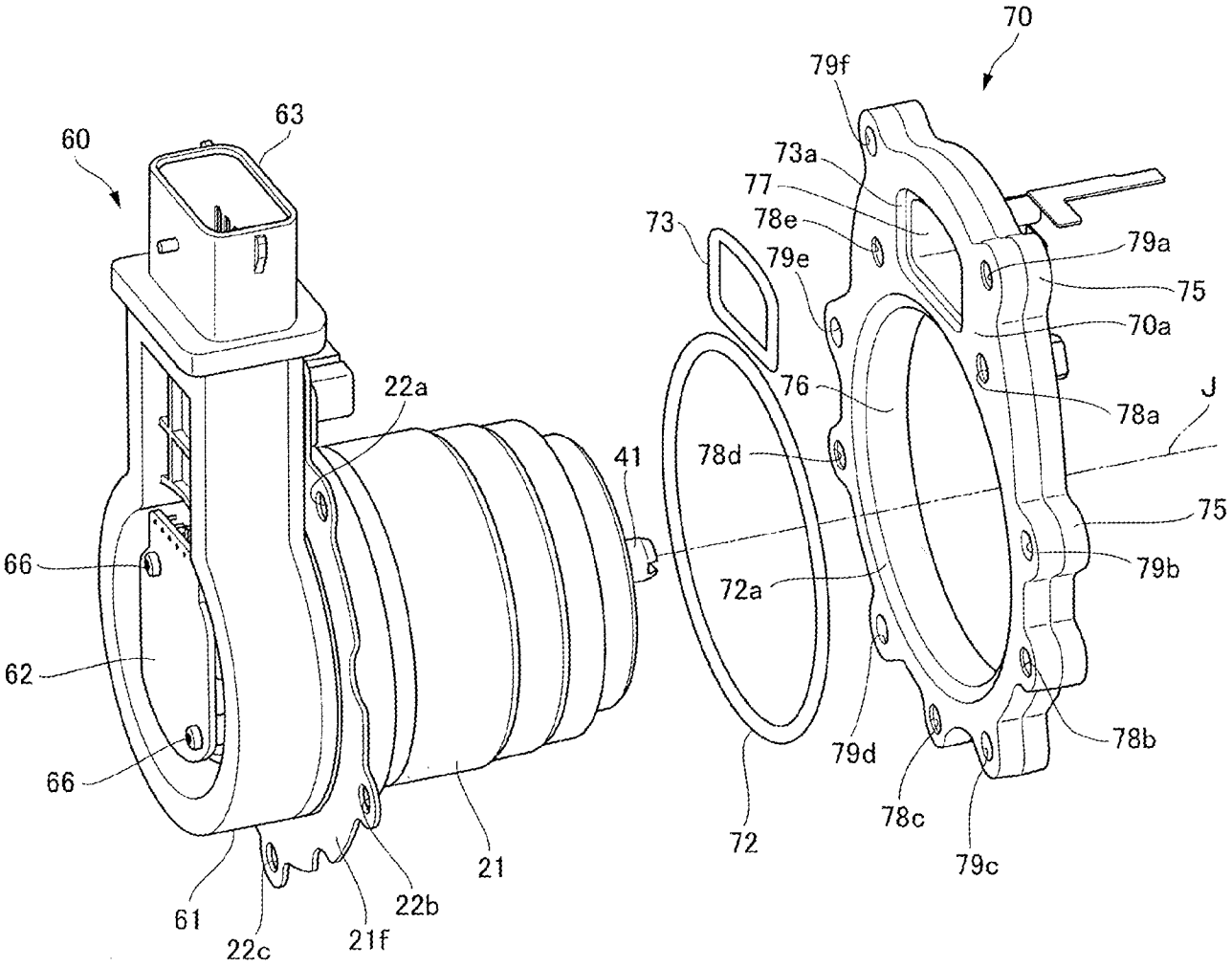
FIG. 4 is a perspective view for explaining an assembly process of the electric oil pump apparatus according to the embodiment.
Figure 5:
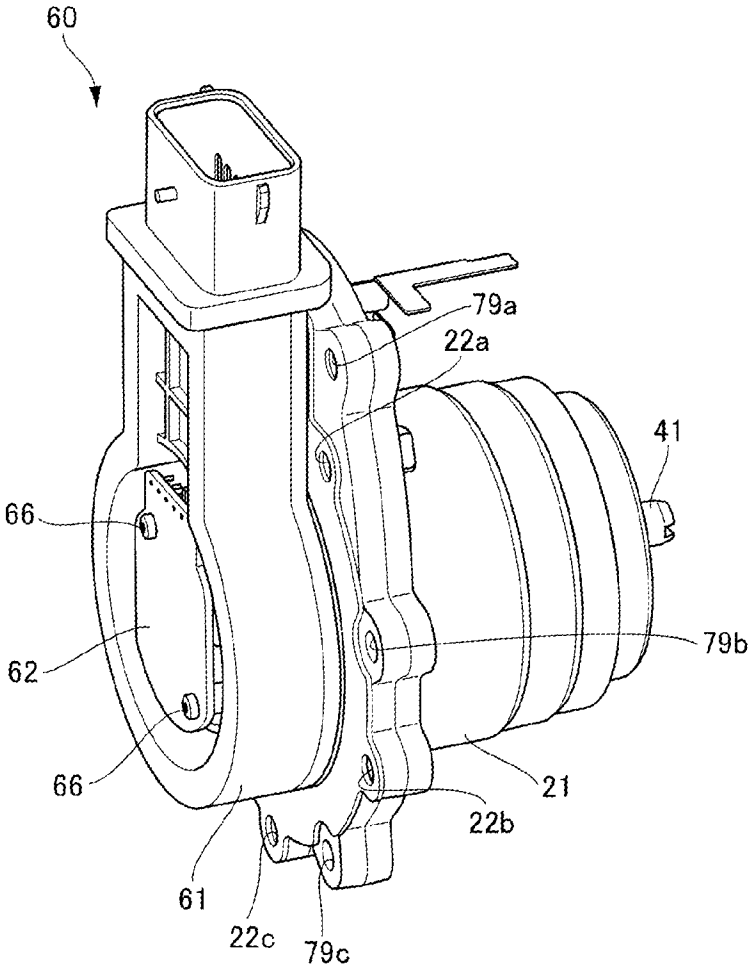
FIG. 5 is a perspective view for explaining the assembly process of the electric oil pump apparatus according to the embodiment.

FIG. 4 and FIG. 5 are perspective views for explaining the process of attaching the base plate unit to the main body.

Before proceeding to the description of this process, the configuration of the base plate unit 70 will be described first.

The base plate unit 70 includes, as shown in FIG. 4, an annular main body 70*a*, a plurality of protruding portions 75, protruding radially outward and aligned in the circumferential direction, a first through hole 76, and a second through hole 77. The inner diameter of the first through hole 76 is larger than the outer diameter of the housing 21, but smaller than the outer diameter of the flange portion 21*f*. In the main body 70*a*, a stepped portion 72*a* for fitting an O-ring 72, serving as the sealing member, is formed along the inner edge of the first through hole 76, on the side opposing the control circuit unit 60. Likewise, a stepped portion 73*a* for fitting an O-ring 73, serving as the sealing member, is formed along the inner edge of the second through hole 77, on the side opposing the control circuit unit 60. In the main body 70*a*, in addition, a non-illustrate groove, for fitting a sealing member with stopper projection 74, is formed on the non-opposing surface, in other words the surface on the side of the pump cover unit 80 shown in FIG. 3.

The protruding portion 75 includes third through holes 78*a*, 78*b*, 78*c*, 78*d*, and 78*e* for coupling the base plate BP with the main body MB and the control circuit cover CC, and fourth through holes 79*a*, 79*b*, 79*c*, 79*d*, 79*e*, and 79*f* for coupling the base plate BP with the joint face on the side of a non-illustrated transmission, the third through holes and the fourth through holes being alternately aligned. Out of the third through holes 78*a*, 78*b*, 78*c*, 78*d*, and 78*e*, the third through holes 78*a* and 78*e*, which are closest to the power supply opening 63, are located on the side of the central axis J, with respect to the fourth through holes 79*a* and 79*f* closest to the power supply opening 63 among the fourth through holes 79*a*, 79*b*, 79*c*, 79*d*, 79*e*, and 79*f*. In contrast, the third through holes 78*b*, 78*c*, and 78*d* and the fourth through holes 79*b*, 79*c*, 79*d*, and 79*e* are concentrically aligned about the central axis J.

Further, the flange portion 21*f* of the housing 21 also includes through holes 22*a*, 22*b*, 22*c*, 22*d*, and 22*e*, sequentially aligned in the circumferential direction (see FIG. 8 to be subsequently referred to, for 22*d* and 22*e*).

The O-ring 72 is fitted to the stepped portion 72*a* of the base plate unit 70 and the O-ring 73 is fitted to the stepped portion 73*a*, and then the housing 21 is passed through the first through hole 76, such that the surface of the base plate unit 70 on which the O-ring 72 and the O-ring 73 are attached is opposed to the flange portion 21*f* of the housing 21. At this point, the third through holes 78*a*, 78*b*, 78*c*, 78*d*, and 78*e* of the base plate unit 70 are respectively opposed to the through holes 22*a*, 22*b*, 22*c*, 22*d*, and 22*e* of the flange portion 21*f* (see FIG. 5 and FIG. 8).

Figure 6:
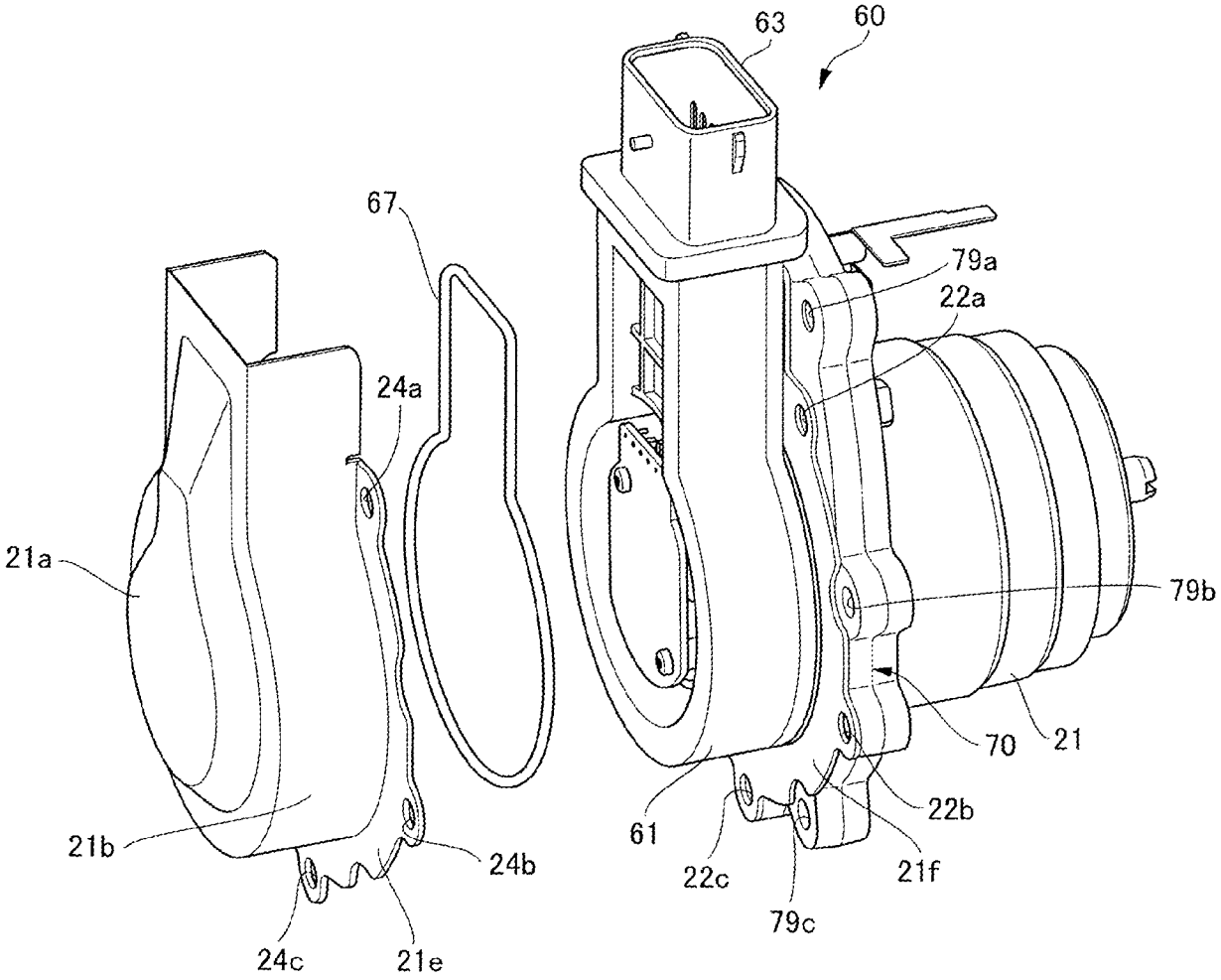
FIG. 6 is a perspective view for explaining the assembly process of the electric oil pump apparatus according to the embodiment.
Figure 7:
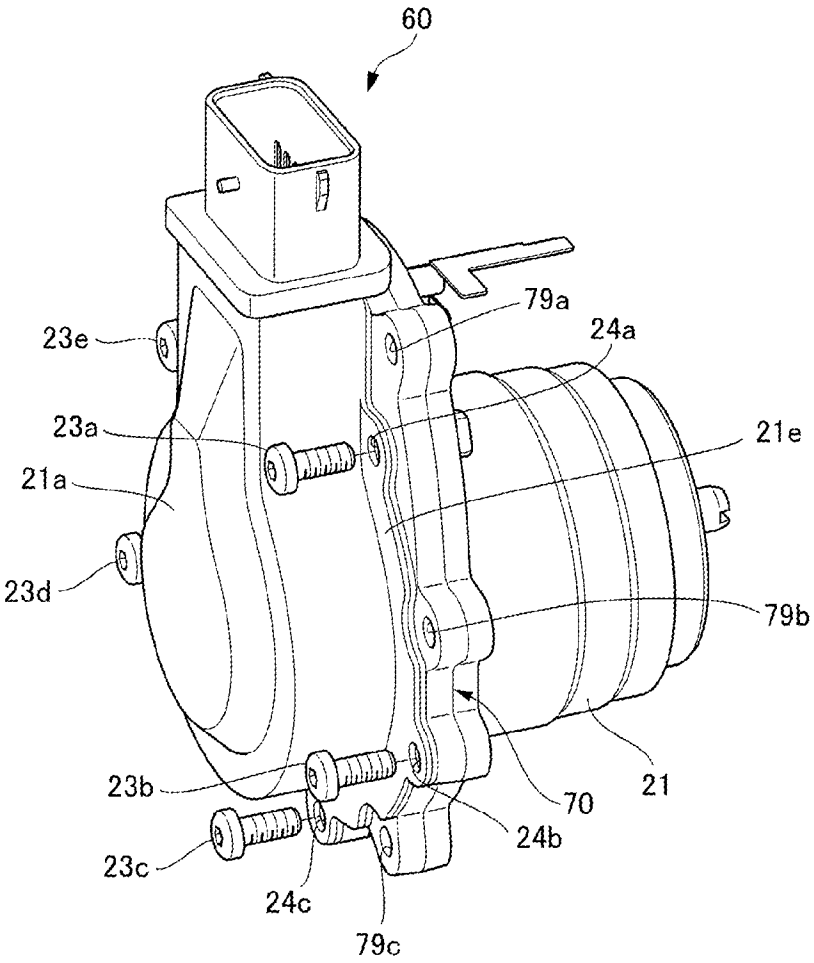
FIG. 7 is a perspective view for explaining the assembly process of the electric oil pump apparatus according to the embodiment.

FIG. 6 and FIG. 7 are perspective views for explaining the process of attaching the control circuit cover CC to the main body. FIG. 8 is a bottom view of the electric oil pump apparatus according to this embodiment.

The bottom portion 21*a*, the control circuit retaining portion 21*b*, and the flange portion 21*e* collectively constitute the control circuit cover CC. The flange portion 21*e* includes through holes 24*a*, 24*b*, 24*c*, 24*d*, and 24*e*, sequentially aligned in the circumferential direction (see FIG. 8 to be subsequently referred to, for 24*d* and 24*e*).

The control circuit cover CC is mounted over the opening of the control circuit case 61, and the flange portion 21*e* is set so as to oppose the flange portion 21*f* of the housing 21. At this point, the through holes 24*a*, 24*b*, 24*c*, 24*d*, and 24*e* of the control circuit cover CC are respectively opposed to the through holes 22*a*, 22*b*, 22*c*, 22*d*, and 22*e* of the flange portion 21*f* (see FIG. 7 and FIG. 8).

Figure 8:
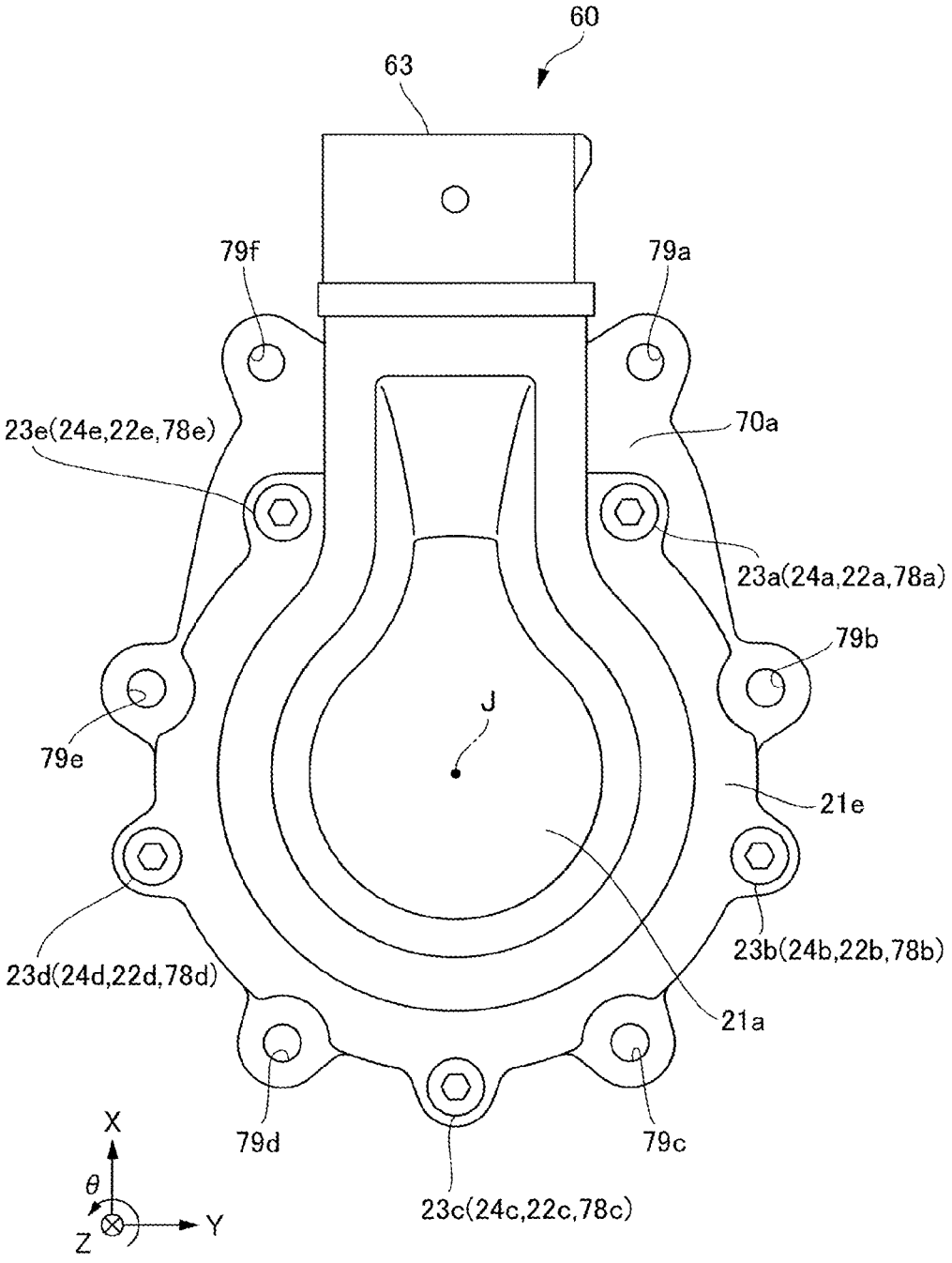
FIG. 8 is a bottom view of the electric oil pump apparatus according to the embodiment.

Then, a screw 23*a* is inserted in the through hole 24*a* of the flange portion 21*e* of the control circuit cover CC, the through hole 22*a* of the flange portion 21*f* of the housing 21, and the third through hole 78*a* of the base plate unit 70, to fasten the mentioned components together (see FIG. 8).

Likewise, a screw 23*b*, a screw 23*c*, a screw 23*d*, and a screw 23*e* are respectively inserted, as is the screw 23*a*, through the through holes 24*b*, 24*c*, 24*d*, and 24*e* of the flange portion 21*e* of the control circuit cover CC, the through holes 22*b*, 22*c*, 22*d*, and 22*e* of the flange portion 21*f* of the housing 21, and the third through holes 78*b*, 78*c*, 78*d*, and 78*e* of the base plate unit 70, to fasten the mentioned components together (see FIG. 8).

Here, instead of sequentially fastening the screw 23*a*, the screw 23*b*, the screw 23*c*, the screw 23*d*, and the screw 23*e*, the diagonally opposite screws may be sequentially fastened, such as fastening the screw 23*d* or screw 23*c* after the screw 23*a*, and fastening the screw 23*b* or screw 23*c* after the screw 23*e*.

Figure 10:
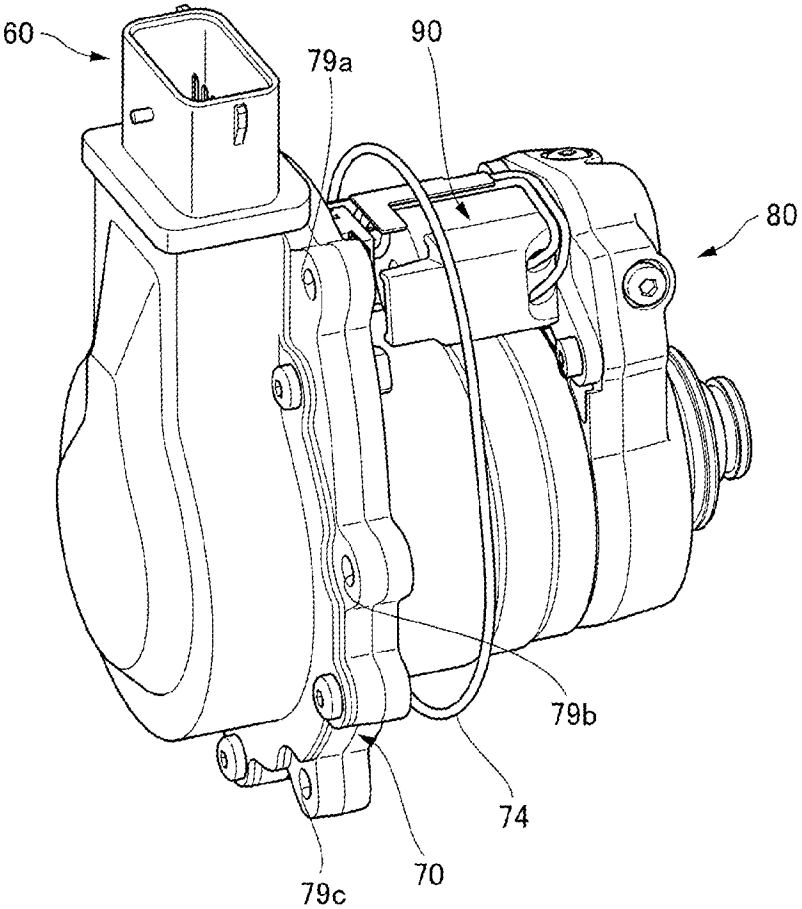
FIG. 10 is a perspective view for explaining the assembly process of the electric oil pump apparatus according to the embodiment.

FIG. 9 and FIG. 10 are perspective views for explaining the process of attaching the pump cover PC to the main body.

First, the pump cover unit 80 is prepared. To the pump cover unit 80, the solenoid unit 90, in which a connector 93 is attached to the terminal of the solenoid valve 91 and the terminal of the pressure sensor 92 on the +Y side with respect to the +Y side, is attached in advance. The pump cover unit 80 is placed over the housing 21, and the connector 93 is inserted in a non-illustrated coupler of the base plate unit 70. Thus, the power source connected to the power supply opening 63 is electrically connected to the solenoid unit 90, via the wiring member 65 (see FIG. 2) and the connector 93.

Finally, the sealing member with stopper projection 74 is fitted, as shown in FIG. 10, in the groove formed in advance on the surface of the base plate unit 70 on the side of the pump cover unit 80. The sealing member with stopper projection 74 includes a projection formed in the radial direction, so as to be firmly fixed to the groove owing to the tension and the effect of the projection. Here, the groove may be formed in various shapes, such as a stepped portion and a recess.

The fourth through holes 79*a*, 79*b*, 79*c*, 79*d*, 79*e*, and 79*f* (see FIG. 8 for 79*d*, 79*e*, and 79*f*) may be utilized for fastening with the joint face on the side of the non-illustrated transmission. In this case, the sealing member 74 can be prevented from falling off from the groove, because of the presence of the stopper projection, even though the control circuit unit 60 is located on the upper side as shown in FIG. 10.

(1) In this embodiment, the base plate unit 70 is fastened with the main body MB, and therefore the sealing can be provided with a simple structure. More specifically, since the flange portion 21*e*, the flange portion 21*f*, the side face of the housing 21 and the base plate unit 70 can be fixed with pressure by using the fastening device 23, oil leakage can be prevented.

(2) In this embodiment, there is no need to form a stepped portion for an O-ring to be fitted in, in the housing main body. More specifically, since the stepped portion 72*a* for accommodating the O-ring 72, and the stepped portion 73*a* for accommodating the O-ring 73 are formed in the base plate unit 70, there is no need to form a recess for inserting an O-ring, in the housing 21. Therefore, the housing 21 made by ordinary press-forming can be broadly utilized for various purposes. Consequently, an electric oil pump that includes a housing made by ordinary press-forming, yet provides an improved sealing effect, can be obtained.

(3) In this embodiment, the sealing member with stopper projection 74 is fitted in the recess formed on the surface of the base plate unit 70 on the side of the pump cover unit 80, the sealing member can be prevented from falling off, even though the recess is oriented downward when the electric oil pump is attached to the transmission.

(4) In this embodiment, the base plate unit 70 overlaps at least a part of the busbar assembly 56, in the radial direction. Therefore, in addition to prevention of oil leakage by the base plate unit 70, the portion corresponding to the thickness of the base plate can be efficiently utilized, so as to reduce the size, in the axial direction, of the electric oil pump with the base plate unit 70 attached thereto.

(5) In this embodiment, the base plate unit 70 overlaps at least a part of the terminal 57, in the radial direction. Therefore, in addition to the prevention of oil leakage by the base plate unit 70, the portion corresponding to the thickness of the base plate can be efficiently utilized, so as to reduce the size, in the axial direction, of the electric oil pump with the base plate unit 70 attached thereto.

(6) In this embodiment, the base plate unit 70 includes the third through holes 78*a*, 78*b*, 78*c*, 78*d*, and 78*e* for fastening the control circuit cover CC, and the fourth through holes 79*a*, 79*b*, 79*c*, 79*d*, 79*e*, and 79*f*, for example for connection to the joint face on the side of the transmission, the third through holes and the fourth through holes being alternately aligned. Therefore, the control circuit cover CC and the transmission side can both be firmly fixed, with a good balance.

(7) In this embodiment, the third through holes 78*a* and 78*e*, which are closest to the power supply opening 63 among the third through holes 78*a*, 78*b*, 78*c*, 78*d*, and 78*e*, are located on the side of the central axis J, with respect to the fourth through holes 79*a* and 79*f* closest to the power supply opening 63 among the fourth through holes 79*a*, 79*b*, 79*c*, 79*d*, 79*e*, and 79*f*. Therefore, the base plate unit 70 can be firmly fixed and prevented from wobbling, despite the presence of the protruding portion such as the power supply opening 63.

(8) In this embodiment, the motor unit 20, the pump unit 30, and the control circuit unit 60 are aligned in the axial direction, so as to form a compact cylindrical shape. Therefore, the electric oil pump can be broadly applicable to various types of transmissions.

Although the embodiment of the invention has been described as above, the foregoing embodiment is merely exemplary and in no way intended to limit the scope to the invention. The embodiment may be implemented in various other forms, and may be omitted, substituted, or modified in various manners within the scope of the invention. The embodiment and the variations thereof are included in the scope of the invention, as well as in the scope defined by the appended claims and the equivalents thereof.

For example, the number, the location, and the shape of the third through hole and the fourth through hole, and the shape of the stepped portion 72*a* and the stepped portion 73*a* may be modified, as the case may be.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An electric oil pump apparatus comprising:

an electric oil pump including:

a cylindrical housing main body that accommodates a motor having an output shaft that rotates about a central axis extending in an axial direction, and a pump driven by the motor;

a flange portion extending radially outward from an outer circumferential surface of the housing main body; and a control circuit case provided on one side of the flange portion in the axial direction, and in which a control circuit that controls the motor is accommodated; and a base plate attached to the electric oil pump, and including:

an annular main body fixed to the outer circumferential surface of the housing main body; and a sealing member located between the annular main body and the housing main body, wherein the annular main body includes:

a first surface located on one side in the axial direction;

a second surface located on the other side in the axial direction;

a first through hole through which the housing main body is passed; and an annular stepped portion configured to accommodate the sealing member, and formed along an inner edge of the first through hole, and the base plate is fastened such that the first surface is opposed to the flange portion.

2. The electric oil pump apparatus according to claim 1, wherein the second surface includes an annular groove for an annular sealing member to be accommodated.

3. The electric oil pump apparatus according to claim 2, wherein the annular sealing member accommodated in the groove includes a projection formed in a radial direction.

4. The electric oil pump apparatus according to claim 1, wherein the base plate includes a second through hole for a terminal in the control circuit case to be connected, at a position outside the housing main body, to a component provided outside the housing main body, the second through hole including an annular stepped portion configured to accommodate the sealing member, and formed along an inner edge.

5. The electric oil pump apparatus according to claim 4, wherein the pump includes:

a pump rotor that can be driven by the motor;

a pump body that covers the pump rotor from one side in the axial direction; and a pump cover that covers the pump rotor from the other side in the axial direction, and the pump cover protrudes radially outward from an outer circumferential surface of the housing main body, on the other side of the housing main body in the axial direction, and at least one of a solenoid valve and a pressure sensor are attached to the pump cover.

6. The electric oil pump apparatus according to claim 1, wherein the electric oil pump includes a busbar assembly accommodated inside an end portion of the housing main body in the axial direction and connected to the motor, and the base plate overlaps at least a part of the busbar assembly, in the radial direction.

7. The electric oil pump apparatus according to claim 1, wherein the electric oil pump includes a terminal connected to one side of the busbar assembly in the axial direction, and to the control circuit, and the base plate overlaps at least a part of the terminal, n the radial direction.

8. The electric oil pump apparatus according to claim 1, wherein the electric oil pump includes a control circuit cover that covers the control circuit case, located on one side of the control circuit case in the axial direction and fastened to the housing main body with a fastening member, and the base plate includes a third through hole for fastening the control circuit cover with the fastening member, and a fourth through hole fastening a joint face of an external device with another fastening member, and the sealing member is located on an inner side with respect to the third through hole and the fourth through hole.

9. The electric oil pump apparatus according to claim 8, wherein a plurality of the third through hole and a plurality of the fourth through hole are alternately aligned in a circumferential direction of the base plate.

10. The electric oil pump apparatus according to claim 9, wherein the control circuit case includes an opening extending in any given direction orthogonal to the axial direction, one of the third through holes closest to the opening is located on a side of the central axis, with respect to one of the fourth through holes closest to the opening.

11. The electric oil pump apparatus according to claim 1, wherein the housing main body includes a press-formed material.

12. The electric oil pump apparatus according to claim 1, wherein the first surface of the base plate directly physically contacts the flange portion.

13. The electric oil pump apparatus according to claim 1, wherein a fastener is provided to directly pass through both the base plate and the flange portion.

14. A base plate for an electric oil pump, the electric oil pump including:

a cylindrical housing main body that accommodates a motor having an output shaft that rotates about a central axis extending in an axial direction, and a pump driven by the motor;

a flange portion extending radially outward from an outer circumferential surface of the housing main body; and a control circuit case provided on one side of the flange portion in the axial direction, and in which a control circuit that controls the motor is accommodated, the base plate comprising:

an annular main body fixed to the outer circumferential surface of the housing main body; and a sealing member located between the annular main body and the housing main body, wherein the annular main body includes:

a first surface located on one side in the axial direction;

a second surface located on the other side in the axial direction;

a first through hole through which the housing main body is passed; and an annular stepped portion configured to accommodate the sealing member, and formed along an inner edge of the first through hole.

15. The base plate according to claim 14, wherein the second surface includes an annular groove for an annular sealing member to be accommodated.

16. The base plate according to claim 14, further comprising a second through hole for a terminal in the control circuit case to be connected, at a position outside the housing main body, to a component provided outside the housing main body, the second through hole including an annular stepped portion configured to accommodate the sealing member, and formed along an inner edge.

17. The base plate according to claim 14, wherein the first surface of the base plate directly physically contacts the flange portion.

18. The base plate according to claim 14, wherein a fastener is provided to directly pass through both the base plate and the flange portion.

* * * * *